US008622370B1

(12) United States Patent
Alenzi

(10) Patent No.: US 8,622,370 B1
(45) Date of Patent: Jan. 7, 2014

(54) AERATOR AIR DISTRIBUTION MANIFOLD

(71) Applicant: Bader Shafaqa Alenzi, Abdulla Almubarak (KW)

(72) Inventor: Bader Shafaqa Alenzi, Abdulla Almubarak (KW)

( * ) Notice: Subject to any disclaimer, the term of this patent is extended or adjusted under 35 U.S.C. 154(b) by 0 days.

(21) Appl. No.: 13/961,865

(22) Filed: Aug. 7, 2013

(51) Int. Cl.
*B01F 3/04* (2006.01)

(52) U.S. Cl.
USPC ..... 261/120; 261/122.1; 210/242.2

(58) Field of Classification Search
USPC ..... 261/120, 121.1, 122.1, 124; 210/242.2
See application file for complete search history.

(56) References Cited

U.S. PATENT DOCUMENTS

| | | | | |
|---|---|---|---|---|
| 3,671,022 | A | 6/1972 | Laird et al. | |
| 4,139,579 | A | 2/1979 | Blum | |
| 4,229,302 | A | 10/1980 | Molvar | |
| 4,268,398 | A | 5/1981 | Shuck et al. | |
| 4,350,648 | A * | 9/1982 | Watkins et al. | 261/120 |
| 4,581,181 | A * | 4/1986 | Nicholls | 261/91 |
| 4,622,139 | A | 11/1986 | Brown | |
| 5,851,448 | A * | 12/1998 | Tyer | 261/122.1 |
| 6,264,176 | B1 | 7/2001 | Dickman et al. | |
| 6,719,911 | B2 | 4/2004 | Bourke | |
| 7,441,754 | B2 | 10/2008 | Trentadue et al. | |
| 7,520,493 | B1 * | 4/2009 | Haldane | 261/120 |
| 2002/0063346 | A1 * | 5/2002 | Lee et al. | 261/120 |
| 2002/0113013 | A1 * | 8/2002 | Long et al. | 210/620 |
| 2005/0269262 | A1 * | 12/2005 | McBride | 210/615 |
| 2008/0000821 | A1 | 1/2008 | Drewelow | |
| 2011/0089098 | A1 * | 4/2011 | Siebert et al. | 210/232 |
| 2011/0121472 | A1 * | 5/2011 | Magen | 261/120 |
| 2012/0228216 | A1 | 9/2012 | Gavrieli et al. | |

FOREIGN PATENT DOCUMENTS

| | | |
|---|---|---|
| GB | 2322565 | 9/1998 |

* cited by examiner

*Primary Examiner* — Charles Bushey
(74) *Attorney, Agent, or Firm* — Richard C. Litman

(57) ABSTRACT

The aerator air distribution manifold has a central plenum disposed at the lower end of a concentric rigid downpipe or duct, and a radial array of diffuser tubes extending from the plenum. Since the aerators are buoyant, the aeration tubes are deployed at a constant, uniform depth below the surface of the water at all times, regardless of the water level. All of the aerator manifolds receive their air supply from a remotely disposed air source. The air source may be based on shore, or may be based upon a ship or other floating vessel. A flexible air supply line or hose extends from the air supply to each of the buoyant aerators, the hose being supported by one or more rigid columns or poles anchored into the bottom of the body of water in which the aerators are placed.

15 Claims, 4 Drawing Sheets

AERATOR AIR DISTRIBUTION MANIFOLD

BACKGROUND OF THE INVENTION

1. Field of the Invention

The present invention relates generally to liquid aeration systems, and more particularly to an aerator air distribution manifold that has a plurality of radially disposed diffuser pipes or tubes extending from a central plenum.

2. Description of the Related Art

The contamination of various bodies of water by various means is an increasingly serious problem worldwide. The most widespread contaminants may be organic materials that enter the water system due to pollution from human habitation, either directly or indirectly, e.g., pollution from farms and the like. Such pollution can affect inland fresh water supplies (lakes and rivers), and can also be carried to the sea by inland rivers and waterways or by direct discharge of sewage and/or other pollutants into the sea. Organic material in the sewage of treatment plants is another example of such pollution, although contained for processing. The biochemical processes that occur in water due to such organic pollution are known to decrease the oxygen content of the water, thereby reducing or even destroying fish and other aquatic life in the contaminated body of water. Even if some fish remain in the polluted water, they are almost certainly unfit for human consumption, if caught.

It is generally considered that the most effective means of eliminating such pollutants in contaminated water is by bacteriological processing, wherein bacteria process the contaminants to break them down into harmless organic materials. However, such bacteria are aerobic, i.e., they require oxygen for their metabolism. This is well known in the sewage treatment field, where water is commonly treated by aeration after solids are removed by settling or other means. Such aeration is generally accomplished by mechanical means, e.g., pumping the water up for dispensing into the air from spray booms and nozzles, or by forcing air through underwater pipes for the air to bubble up through the water. Such mechanical systems are relatively costly to operate and require relatively high energy and manpower costs. Even if such systems were less costly to operate, a huge drawback is that they cannot be readily transported to a pollution site for operation at that site. Rather, the water must be transported to the location of the aeration system, a process that is clearly unworkable on a very large scale and/or over very long distances.

Another consideration is the frequent need to position the air diffuser(s) at a constant depth below the surface of the water in which the aerator is installed in order to simplify pressure regulation of the airflow. This is not a significant problem in settling ponds and the like, but can be a significant problem in bodies of water wherein the level changes from time to time, as in reservoirs with controlled outlets and bodies of water influenced by tidal action.

Thus, an aerator air distribution manifold solving the aforementioned problems is desired.

SUMMARY OF THE INVENTION

The aerator air distribution manifold is used on at least one buoyant aerator for aerating a body of water. The air distribution manifold of each of the aerators comprises a central plenum disposed at the lower end of a concentric rigid downpipe or duct, and a radial array of diffuser tubes extending from the plenum. As the aerators are buoyant, the aeration tubes are deployed at a constant, uniform depth below the surface of the water at all times, regardless of the water level. All of the manifolds receive their air supply from a remotely disposed air source. The air source may be based on shore, or may be based upon a ship or other floating vessel. A flexible air supply line or hose extends from the air supply to each of the buoyant aerators. The hose is supported by one or more rigid columns or poles anchored into the bottom of the body of water in which the aerators are placed.

A first embodiment of the buoyant aerator has a toroidal float and a plurality of legs extending down from the periphery of the float. The air distribution manifold comprises a radial array of aeration tubes or nozzles affixed at the lower end of a down tube, pipe, or duct disposed between the legs and below the float. A second embodiment of the buoyant aerator is anchored to a non-buoyant, sunken base that is permanently placed upon the floor of a body of water. A plurality of substantially vertical guide columns extends upward from the base. The toroidal float is installed and captured between the guide columns. The float is free to float up and down along the guide columns as the water level changes. The down tube or pipe depends through the center of the toroidal float, and moves up and down between the guide columns as the float moves up and down. The air distribution manifold and its plurality of radial diffuser pipes extend from the lower end of the down tube.

As the float remains atop the water in both aerator embodiments, the radial array of aeration tubes remains at a constant depth below the surface, so that the air supply remains at a constant pressure with no need for variance. A plurality of such buoyant aerators may be placed in a body of water, all of the aerators receiving their air supply from a single remotely located source.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The aerator air distribution manifold is installed upon various embodiments of buoyant aerators with remote air supplies. Different means are provided for securing the aerators to the floor of the body of water in which they are installed and different air supply sources are provided, but all of the embodiments make use of the same air distribution manifold configuration.

Figure 1:
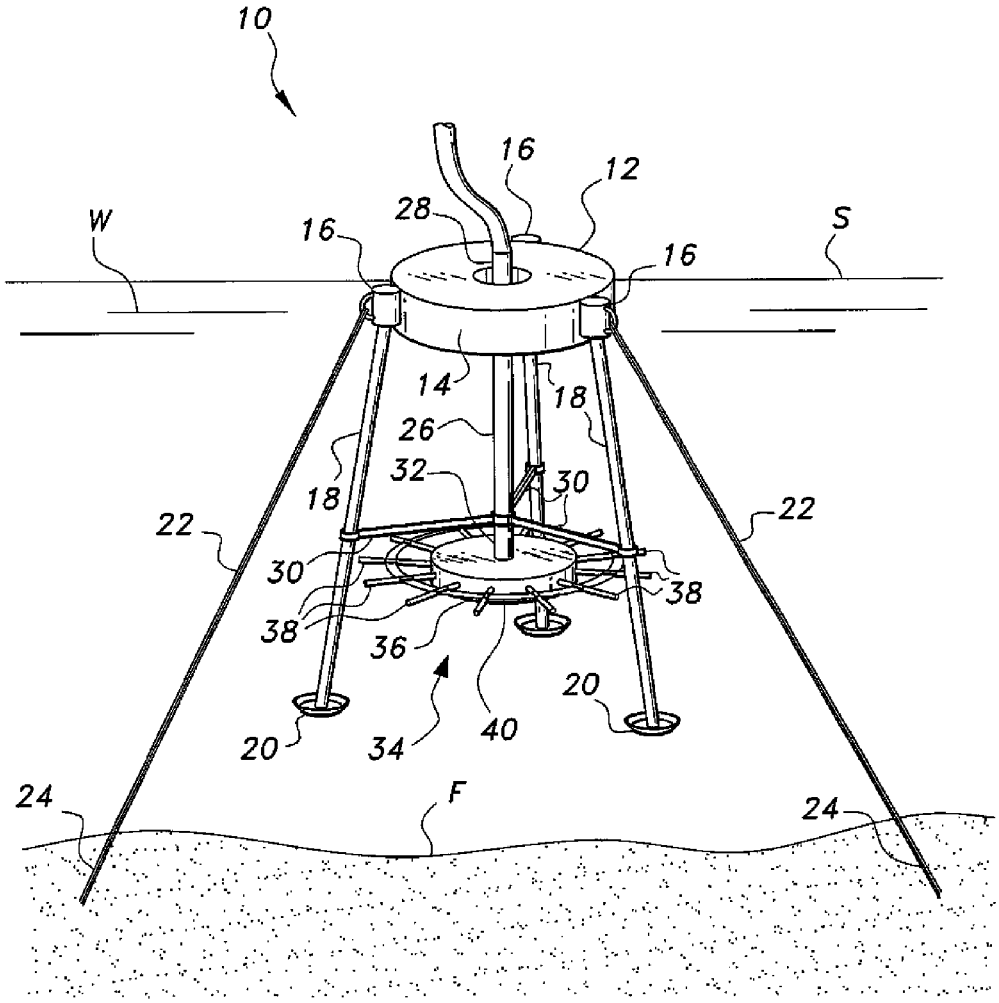
FIG. 1 is a detailed environmental perspective view of an aerator air distribution manifold according to the present invention, shown installed on a buoyant aerator having a plurality of support legs immovably affixed and depending from a toroidal float.

FIG. 1 of the drawings provides a perspective view of a first buoyant aerator 10. This aerator comprises a buoyant toroidal float 12 having a periphery 14 and a plurality of leg attachment points or fittings 16 installed thereon. Corresponding rigid support legs 18 extend from the fittings. Each leg has a support pad or foot 20 at the base thereof. Corresponding anchor cables or lines 22 extend from the leg attachment points 16. The distal ends 24 of the cables 22 are anchored into the floor F of the body of water W to prevent the aerator 10 from drifting from its installed position. Each of the legs 18 has a fixed length, so that the support pads 20 remain clear of the floor F of the body of water W when the water depth is greater than the vertical lengths of the legs 18. If the water depth becomes less than the vertical lengths of the legs 18, e.g., due to tidal action, change in level in a reservoir, etc., the support pads 20 rest upon the floor F of the body of water W to support the aerator structure at a predetermined height above the floor F to preclude its contamination with mud or other bottom debris.

The aerator 10 has a single central air delivery column 26 extending substantially vertically through the center hole or passage of the toroidal float 12. The upper end 28 of the column 26 is preferably immovably affixed to the float 12 by suitable braces or the like (not shown) where it passes through the center of the float 12, and by additional similar but longer braces 30 extending from the lower portion or end 32 of the column to each of the support legs 18.

An aeration outlet 34 is immovably affixed to the lower end 32 of the air delivery column 26, and thus to the remaining structure of the aerator 10. The aeration outlet 34 comprises a relatively flat or thin circular central plenum 36 and a plurality of radially disposed and perforated aeration tubes or nozzles 38 extending therefrom. A circular brace 40 is disposed concentrically about the aeration or diffuser tubes 38 and spaced outwardly from the plenum 36, tying the tubes 38 together for greater security. Since the aeration outlet 34 is immovably affixed to the remaining structure of the aerator 10, including its float 12, it will be seen that the aeration tubes 38 remain at a constant fixed depth below the float 12. Thus, as the float 12 rides upon the surface of the water (assuming adequate water depth so that the legs 18 are not resting upon the floor F of the body of water W), the aeration tubes 38 also remain at a constant fixed depth below the surface of the water. Since this depth is fixed, the water pressure or head at the depth of the aeration tubes is also fixed, thus requiring a constant air pressure from the air supply of either FIG. 3 or FIG. 4. No adjustment of the air pressure is required for the aerator 10 once the pressure has been set.

Figure 2:
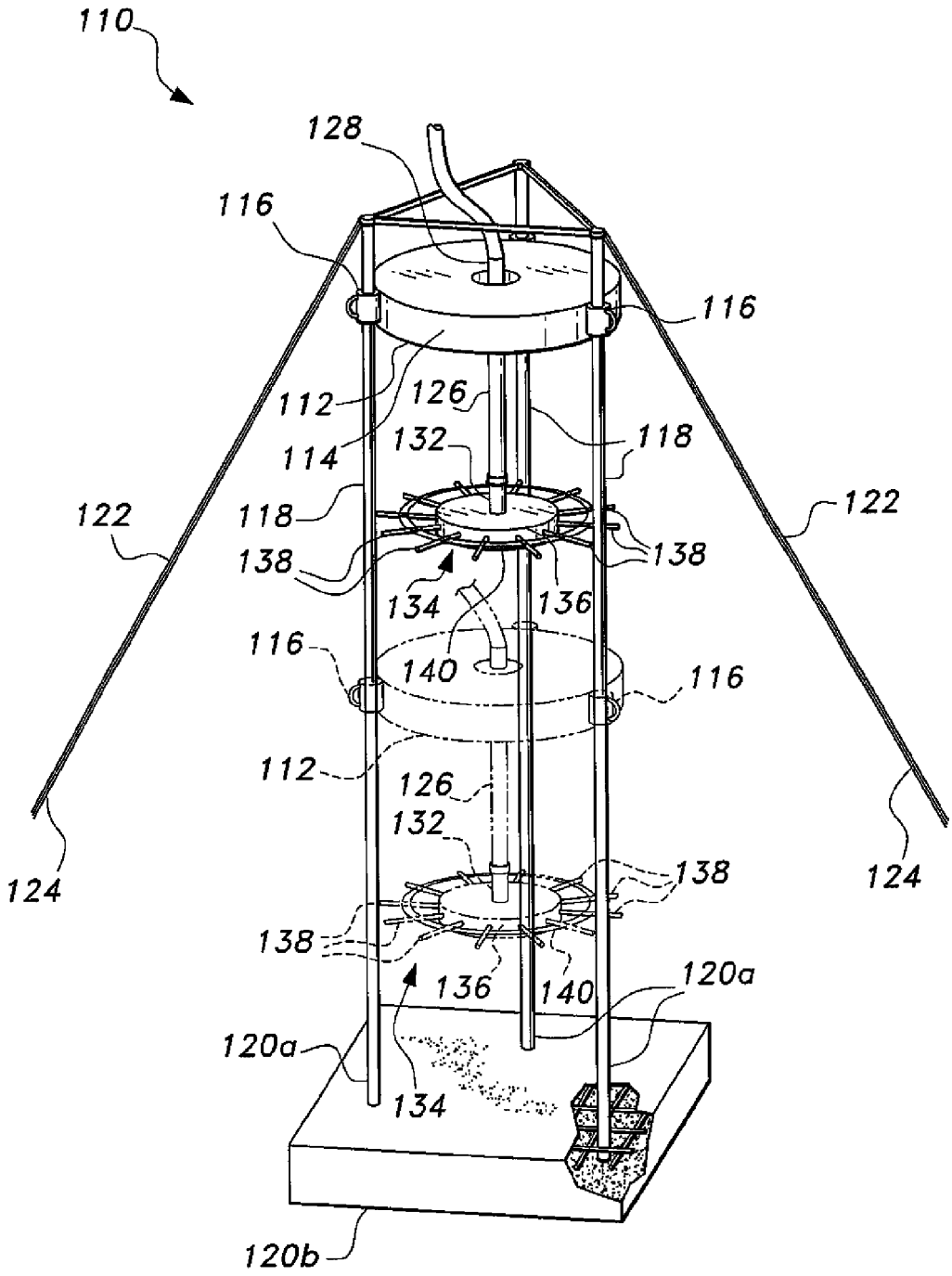
FIG. 2 is an environmental, perspective view of the aerator air distribution manifold according to the present invention installed upon a different buoyant aerator having a plurality of parallel support columns anchored to the bottom of the body of water, the toroidal float, air delivery duct, and air distribution manifold being buoyantly supported between the columns.
Figure 3:
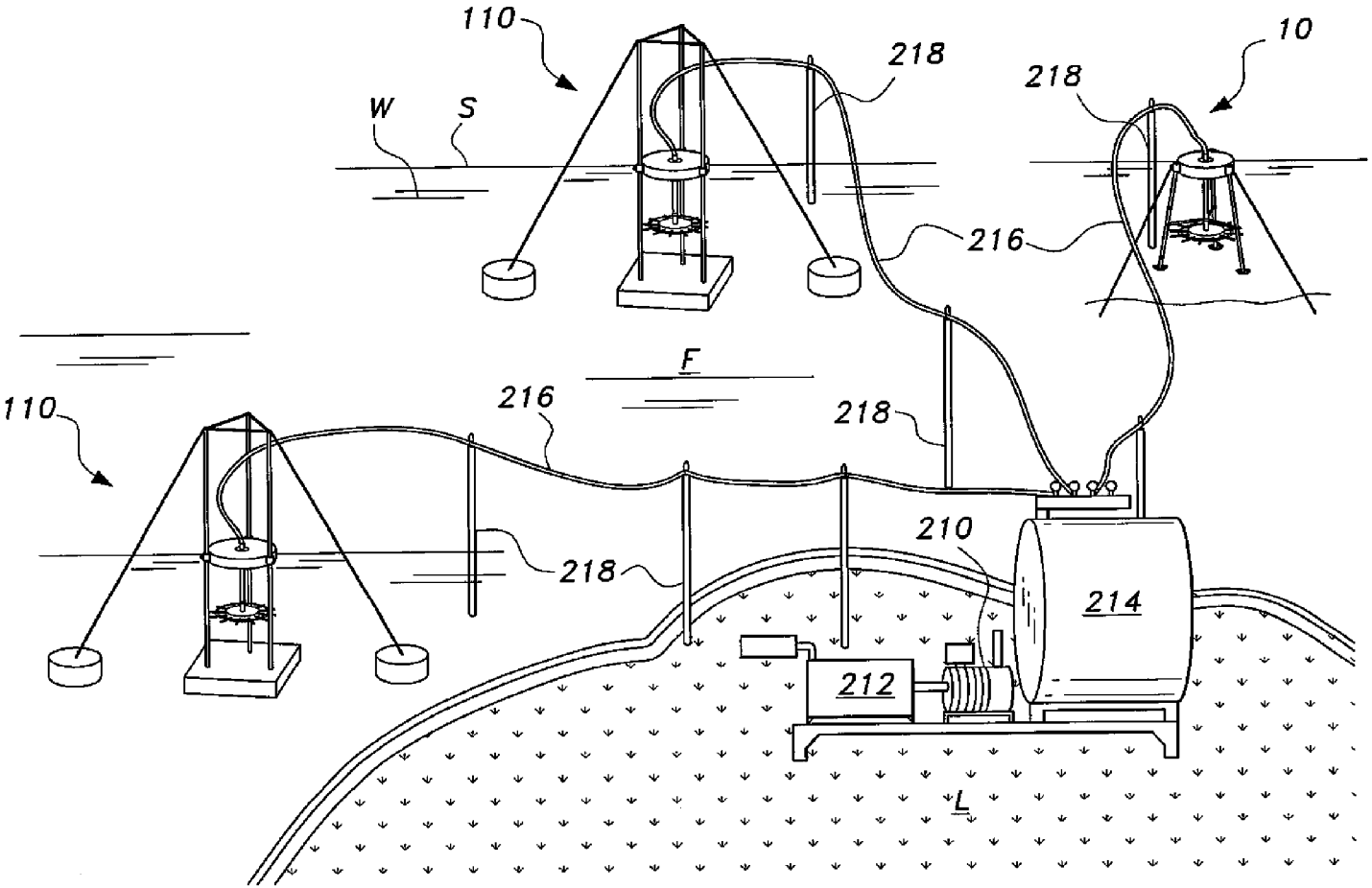
FIG. 3 is an environmental, perspective view of an array of buoyant aerators of different types, each of the aerators being equipped with an aerator air distribution manifold according to the present invention, further illustrating a remotely disposed air supply based on shore.
Figure 4:
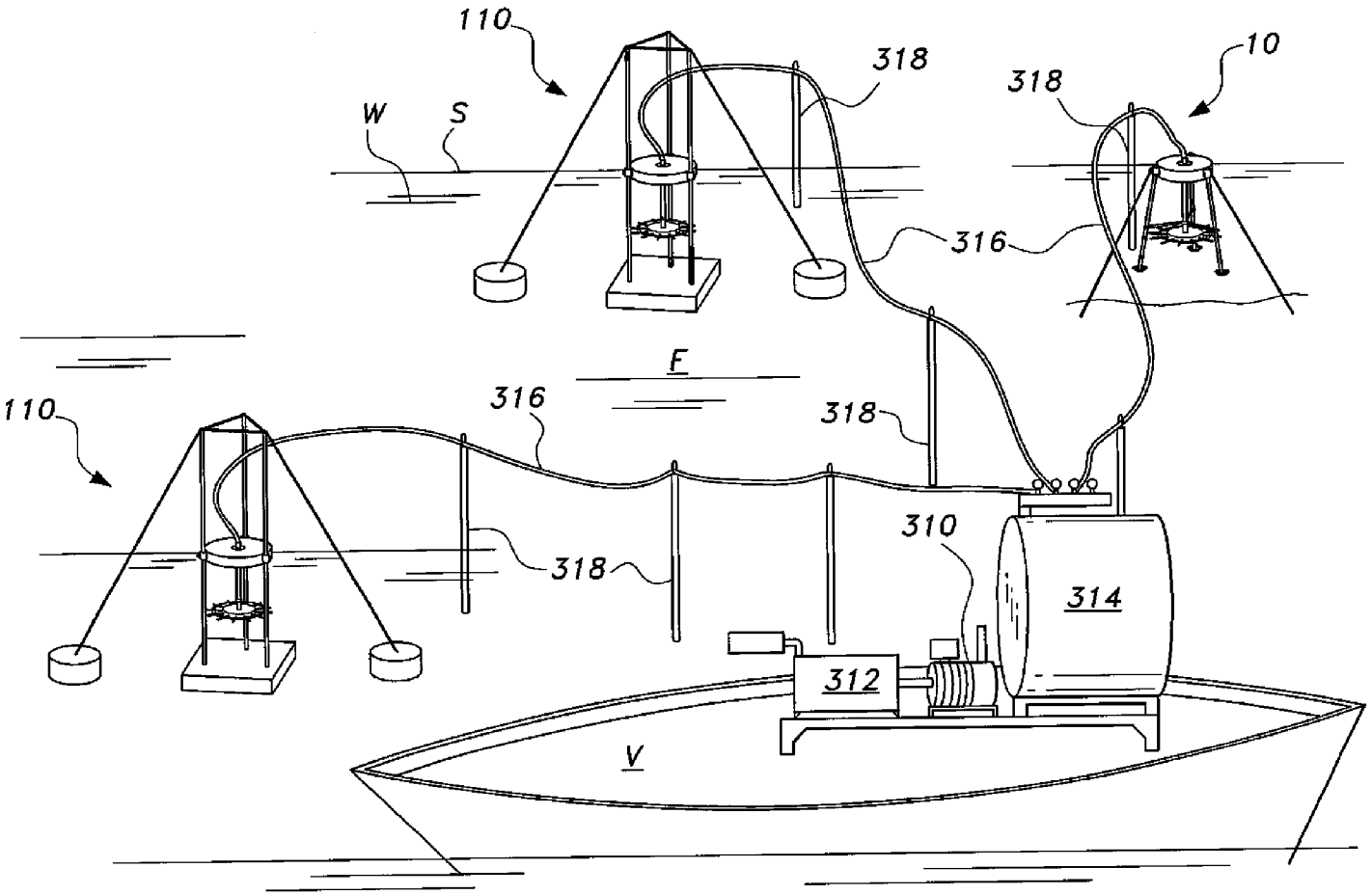
FIG. 4 is an environmental, perspective view of an array of buoyant aerators of different types, each of the aerators being equipped with an aerator air distribution manifold according to the present invention, further illustrating an air supply based upon a floating vessel.

FIG. 2 of the drawings provides a perspective view of another buoyant aerator, designated as aerator 110. The aerator 110 includes many components that correspond to those like components of the buoyant aerator 10 illustrated in FIG. 1 and described above. The aerator 110 has a buoyant toroidal float 112 having a periphery 114 and a plurality of leg attachment passages 116 installed thereon. Corresponding parallel rigid vertical guides 118 have lower ends 120*a* anchored or immovably affixed in a heavy base 120*b* of concrete or the like. The base of the aerator 110 rests immovably upon the floor F of the body of water W, as shown in FIGS. 3 and 4. This structure allows the float 112 to move vertically between the guides 118 as the water level changes, the leg attachment passages 116 sliding vertically along the guides 118. Corresponding anchor cables or lines 122 extend from the leg attachment passages 116. The distal ends 124 of the cables 22 are anchored into the floor F of the body of water W (shown in FIGS. 3 and 4) to provide further security for the aerator 110.

The aerator 110 has a single central air delivery column 126 extending substantially vertically through the center hole or passage of the toroidal float 112. The upper end 128 of the column 126 is preferably immovably affixed to the float 112 by suitable conventional braces or the like (not shown) where it passes through the center of the float 112. An aeration outlet 134 is immovably affixed to the lower end 132 of the air delivery column 126, and thus to the remaining structure of the aerator 110. The aeration outlet 134 comprises a relatively flat or thin circular central plenum 136 and a plurality of radially disposed and perforated aeration tubes or nozzles 138 extending therefrom. A circular brace 140 is disposed concentrically about the aeration or diffuser tubes 138 and spaced outwardly from the plenum 136, tying the tubes 138 together for greater security.

In FIG. 2, the position of the float 112, air delivery column 126, and aeration outlet 134 is shown with the float positioned near the upper ends of the vertical guides 118 in solid lines, as would be the case with a relatively high water level. If the water level decreases, the float 112 with its attached air delivery column 126 and aeration outlet 134 will descend with the water level, thus lowering the float, column, and aerator outlet, as shown in broken lines in FIG. 2. Since the aeration outlet 134 is immovably affixed to the lower end 132 of the air delivery column 126 and the air delivery column 126 is immovably affixed to the float 112, it will be seen that the aeration tubes 138 remain at a constant fixed depth below the float 112. Thus, as the float 112 rides upon the surface of the water (assuming adequate water depth so that the aeration outlet 134 is not resting upon the anchor base 120*b*), the aeration tubes 138 also remain at a constant fixed depth below the surface of the water. Since this depth is fixed, the water pressure or head at the depth of the aeration tubes is also fixed, thus requiring a constant air pressure from the air supply of either FIG. 3 or FIG. 4. No adjustment of the air pressure is required for the aerator 110 once the pressure has been set.

FIG. 3 of the drawings is a pictorial illustration of a buoyant aerator array, showing a plurality of different types of buoyant aerators receiving their air supplies from a single land-based source. The source of air for the buoyant aerators includes a compressor 210 driven by a suitable power source 212 (e.g., gasoline or diesel engine, electric motor, etc.). The compressor 210 delivers air to an air tank 214 to supply the offshore buoyant aerators. The compressor 210, power source 212, and air tank 214 are all installed and based upon the shore or land mass L, clear of the water W. Air is delivered to the various aerators by a separate flexible air delivery line 216 extending from the air tank 214 to each of the aerators, so that each aerator has its own air delivery line 216. Each of the delivery lines 216 is supported above the surface S of the water W by one or more support columns 218. Each of the support columns 218 is immovably affixed and anchored in the underlying land mass L or the floor F of the body of water W.

FIG. 4 of the drawings is a pictorial illustration of another buoyant aerator array, showing a plurality of different types or embodiments of buoyant aerators receiving their air supplies from a single floating vessel-based source. The source of air for the buoyant aerators includes a compressor 310 driven by a suitable power source 312 (e.g., gasoline or diesel engine, electric motor, etc.). The compressor 310 delivers air to an air tank 314 to supply the offshore buoyant aerators. The compressor 310, power source 312, and air tank 314 are all installed and based upon the floating vessel V in the water W. Air is delivered to the various aerators by a separate flexible air delivery line 316 extending from the air tank 314 to each of the aerators, so that each aerator has its own air delivery line 316. Each of the delivery lines 316 is supported above the surface S of the water W by one or more support columns 318. Each of the support columns 318 is immovably affixed and anchored in the floor F of the body of water W.

While each of FIGS. 3 and 4 shows only three aerators, it will be seen that more aerators may be supplied by a single air source, depending upon the amount of air used by each aerator and the capacity of the air supply.

It is to be understood that the present invention is not limited to the embodiments described above, but encompasses any and all embodiments within the scope of the following claims.

I claim:

1. An aerator air distribution manifold for a buoyant aerator, the aerator being adapted for buoyant placement upon the surface of a body of water, the body of water having a floor and being adjacent to a land mass, the aerator air distribution manifold comprising:

a central plenum;

a plurality of porous air diffuser tubes extending radially from the plenum in a generally horizontal plane;

a circular brace disposed concentrically about the air diffuser tubes and the plenum, the brace being separated outwardly from the plenum;

a rigid air duct having a lower end and an upper end opposite the lower end, the plenum being affixed concentrically to the lower end of the air duct; and a toroidal float, the air duct passing concentrically through the toroidal float.

2. The aerator air distribution manifold according to claim 1, further comprising:

an air supply remotely disposed from the air duct; and an air delivery line extending from the air supply to the upper end of the air duct.

3. The aerator air distribution manifold according to claim 2, further comprising at least one support column supporting the air delivery line, the at least one support column being anchored and immovably affixed to the floor of the body of water.

4. The aerator air distribution manifold according to claim 2, wherein the air supply is disposed upon the land mass remote from the aerator, the air supply including a compressor, a power source selectively driving the compressor, and an air tank, the air supply being disposed above the surface of the water and clear of the water.

5. The aerator air distribution manifold according to claim 2, wherein the air supply is disposed upon a floating vessel remote from the aerator, the air supply including a compressor, a power source selectively driving the compressor, and an air tank, the air supply being disposed above the surface of the water and clear of the water.

6. A buoyant aerator, the aerator being adapted for buoyant placement upon the surface of a body of water, the body of water having a floor and being adjacent to a land mass, the buoyant aerator comprising:

a toroidal float having a periphery;

an air duct having a lower end and an upper end opposite the lower end, the air duct passing concentrically through the toroidal float;

a plurality of support legs, each of the support legs being of fixed length and having an upper attachment end rigidly affixed to the periphery of the float and an opposite lower end;

a flexible anchor cable extending from the upper attachment end of each of the support legs;

a footpad disposed upon the lower end of each of the support legs; and an aerator air distribution manifold having:

a central plenum affixed concentrically to the lower end of the air duct;

a plurality of porous air diffuser tubes extending radially from the plenum in a generally horizontal plane; and a circular brace disposed concentrically about the air diffuser tubes and the plenum, the brace being separated outwardly from the plenum.

7. The buoyant aerator according to claim 6, further comprising:

an air supply remotely disposed from the air duct; and an air delivery line extending from the air supply to the upper end of the air duct.

8. The buoyant aerator according to claim 7, further comprising at least one support column supporting the air delivery line, the at least one support column being anchored and immovably affixed to the floor of the body of water.

9. The buoyant aerator according to claim 7, wherein the air supply is disposed upon the land mass remote from the aerator, the air supply including a compressor, a power source selectively driving the compressor, and an air tank, the air supply being disposed above the surface of the water and clear of the water, the air delivery line extending above the surface of the water from the air supply to the upper end of the air duct.

10. The buoyant aerator according to claim 7, further comprising a floating vessel remotely disposed from the aerator, the air supply being disposed upon the floating vessel, the air supply including a compressor, a power source selectively driving the compressor, and an air tank, the air supply being disposed above the surface of the water and clear of the water, the air delivery line extending above the surface of the water from the air supply to the upper end of the air duct.

11. A buoyant aerator, the aerator being adapted for buoyant placement upon the surface of a body of water, the body of water having a floor and being defined by a land mass, the buoyant aerator comprising:

a toroidal float having a periphery;

an air duct having a lower end and an upper end opposite the lower end, the air duct passing concentrically through the toroidal float;

a non-buoyant, sunken base;

a plurality of guide columns extending upward from the base, the toroidal float being captured between and slidable on the guide columns; and an aerator air distribution manifold having:

a central plenum affixed concentrically to the lower end of the air duct;

a plurality of porous air diffuser tubes extending radially from the plenum in a generally horizontal plane; and a circular brace disposed concentrically about the air diffuser tubes and the plenum, the brace being separated outwardly from the plenum.

12. The buoyant aerator according to claim 11, further comprising:

an air supply remotely disposed from the air duct; and an air delivery line extending from the air supply to the upper end of the air duct.

13. The buoyant aerator according to claim 12, further comprising at least one support column supporting the air delivery line, the at least one support column being anchored and immovably affixed to the floor of the body of water.

14. The buoyant aerator according to claim 12, wherein:

the air supply is disposed upon the land mass remote from the aerator;

the air supply includes a compressor, a power source selectively driving the compressor, and an air tank, the air supply being disposed above the surface of the water and clear of the water; and the air delivery line extends above the surface of the water from the air supply to the upper end of the air duct.

15. The buoyant aerator according to claim 12, further comprising a floating vessel remotely disposed from the aerator array, wherein:

the air supply is disposed upon the floating vessel;

the air supply includes a compressor, a power source selectively driving the compressor, and an air tank, the air supply being disposed above the surface of the water and clear of the water; and the air delivery line extends above the surface of the water from the air supply to upper end of the air duct.

* * * * *